US012097937B2

(12) United States Patent
Knapp et al.

(10) Patent No.: US 12,097,937 B2
(45) Date of Patent: Sep. 24, 2024

(54) COMBINATION FLOAT AND BRACKET ASSEMBLY

(71) Applicants: Lee Knapp, Silverdale, WA (US); Tim Knapp, Silverdale, WA (US)

(72) Inventors: Lee Knapp, Silverdale, WA (US); Tim Knapp, Silverdale, WA (US)

( * ) Notice: Subject to any disclaimer, the term of this patent is extended or adjusted under 35 U.S.C. 154(b) by 502 days.

(21) Appl. No.: 17/399,750

(22) Filed: Aug. 11, 2021

(65) Prior Publication Data

US 2022/0048602 A1 Feb. 17, 2022

Related U.S. Application Data

(60) Provisional application No. 63/064,192, filed on Aug. 11, 2020.

(51) Int. Cl.
*B63C 1/02* (2006.01)
*E02B 3/06* (2006.01)

(52) U.S. Cl.
CPC ..... *B63C 1/02* (2013.01); *E02B 3/064* (2013.01)

(58) Field of Classification Search
CPC ..... B63C 1/02; E02B 3/064; B63B 35/38
See application file for complete search history.

(56) References Cited

U.S. PATENT DOCUMENTS 3,760,754 A * 9/1973 Drummond ..... B63B 35/34 405/211
5,199,371 A * 4/1993 Meriwether ..... E02B 3/064 405/219
5,215,027 A * 6/1993 Baxter ..... E02B 3/062 114/65 A
6,205,945 B1 * 3/2001 Passen ..... B63B 35/38 405/219
2009/0000169 A1 * 1/2009 Houssain ..... G09F 15/0068 40/605
2009/0320736 A1 * 12/2009 Gerst ..... B63B 35/38 114/263
2016/0059938 A1 * 3/2016 Momayez ..... H02S 10/40 440/49

* cited by examiner

*Primary Examiner* — Andrew Polay
(74) *Attorney, Agent, or Firm* — Dean A. Craine, P.S.

(57) ABSTRACT

A combination float and bracket assembly for a floating structure that includes a float body made of closed-cell foam with a plurality of transversely aligned L-shaped brackets that extend upward from the float body's top surface. Each bracket includes horizontal and vertical flanges, During manufacturing, a plurality of bracket cutouts are formed in the float body's top surface, and a bracket is then inserted into each bracket cutout so that the brackets' vertical flanges extend upward above the top surface. Connectors attach the vertical flanges to a frame member. In one embodiment, a transversely aligned void area is formed in the float body adjacent to the vertical flange. The void area receives the frame member that extends over the top surface of the float body and attaches to the vertical flange. Also disclosed is a floating structure with a frame attached to a plurality of float and bracket assemblies.

11 Claims, 7 Drawing Sheets

COMBINATION FLOAT AND BRACKET ASSEMBLY

This utility patent application is based on and claims the filing date benefit of U.S. Provisional patent application (Application No. 63/064,192) filed on Aug. 11, 2020.

Notice is given that the following patent document contains original material subject to copyright protection. The copyright owner has no objection to the facsimile or digital download reproduction of all or part of the patent document but otherwise reserves all copyrights.

BACKGROUND OF THE INVENTION

1. Field of the Invention

This invention pertains to float assemblies for floating structures, such as docks, rafts or ramps and, more particularly, to float assemblies with foam float bodies and with brackets partially embedded into the float body that securely attach to the floating structure's frame.

2. Description of the Related Art

The most common type of float for commercial and residential floating rafts or docks is the roto-mold tub. These tubs are square polyethylene shells filled with expanded polystyrene foam (also called EPS foam). Formed on the tub's top surfaces are flanges with slots or holes that receive lag bolts attached to the raft's or dock's frame.

One problem with roto-mold tubs is that they have flat top surfaces which capture water that becomes stagnant. As a result, twigs, blue-green algae, and fecal matter floating in the water are trapped on the top surface, producing offensive odors and challenging to wash off.

Another problem with roto-mold tubs is that they only provide buoyancy and little no structural support for the frame. As a result, the frame must be built with more robust, heavier materials and with special brackets and hangers used to interconnect the frame members.

Another problem with roto-mold tubs is that they must be turned upside down during the construction of a raft or dock so the flanges on the tubs are positioned on the bottom surfaces of the frame members. Lag bolts are then driven downward through into the flanges and the frame members. Once all the tubs are attached to the frame members, the entire frame and tubs must be rotated and usually requires special equipment, so that decking material may then be installed over the top surface of the frame.

Another problem with square or rectangular-shaped roto-mold tubs is that they occupy large water areas under the raft or dock. Many municipalities require residential rafts or docks only 64 square feet or greater to allow at least 50% effective light to pass through the decking to illuminate the water under the raft or dock. This means that on an 8'×8' raft, at least 32 square feet of the total surface of the decking must have nothing underneath the decking that blocks light. With roto-mold tubs achieving this 50% light illumination requirement is difficult to achieve.

SUMMARY OF THE INVENTION

A combination float and bracket assembly to construct floating structures, such as floating rafts, docks, or ramps. The assembly includes a float body made of foam covered with a durable protective layer. The float body includes a curved or dome-shaped top surface to minimize the formation of stagnant water and debris buildup. A plurality of T-shaped or L-shaped brackets is embedded into the float body and extending upward from the top surface. The upper edges of the brackets connect to the floating structure's frame. The protective layer is a polyurea coating applied to the entire outer surface of the float body, which protects the float body and also seals and locks the brackets onto the float body.

Each bracket includes a horizontal flange and a perpendicularly aligned vertical flange. The horizontal flange is a flat plate configured to extend horizontally and transversely through the upper portion of the float body. The vertical flange is a flat plate that extends upward from the horizontal flange. The upper portion of the vertical flange is positioned above the curved top surface. The vertical flange is also slightly offset from the horizontal flange's longitudinal axis thereby dividing the horizontal flange into a large first section and a smaller second section. The upper portion of the vertical flange includes holes that receive threaded connectors.

In one embodiment, the brackets fit into a bracket cutout formed in the float body with a hot wire cutter. However, it should be understood the bracket could also be inserted into a mold and liquid foam could be poured into the mold to embed the horizontal flanges into the float body.

In one embodiment, a void space is created, or formed on the top surface of the float body adjacent to the vertical flanges on some or all of the brackets. The void space is sufficient in width and depth to receive a frame member extending transversely over the float body. The top surface of the frame member is exposed, thereby enabling decking to be attached to the frame member. By inserting a frame member into the void space adjacent to the bracket, the frame member is not only attached to the bracket but also physically locked onto the float body creating a uniform structure.

In another embodiment, the void space in the float body is eliminated and the bracket includes a modified vertical flange configured to extend a greater distance above the top surface of the float body and attaches to a frame member extending transversely above the float body. The modified vertical flange also includes holes that receive threaded connectors that attach to the frame member.

Using the above described float and bracket assembly, a floating structure is constructed.

DESCRIPTION OF TILE DRAWINGS

DESCRIPTION OF THE PREFERRED EMBODIMENT(S)

Figure 1:
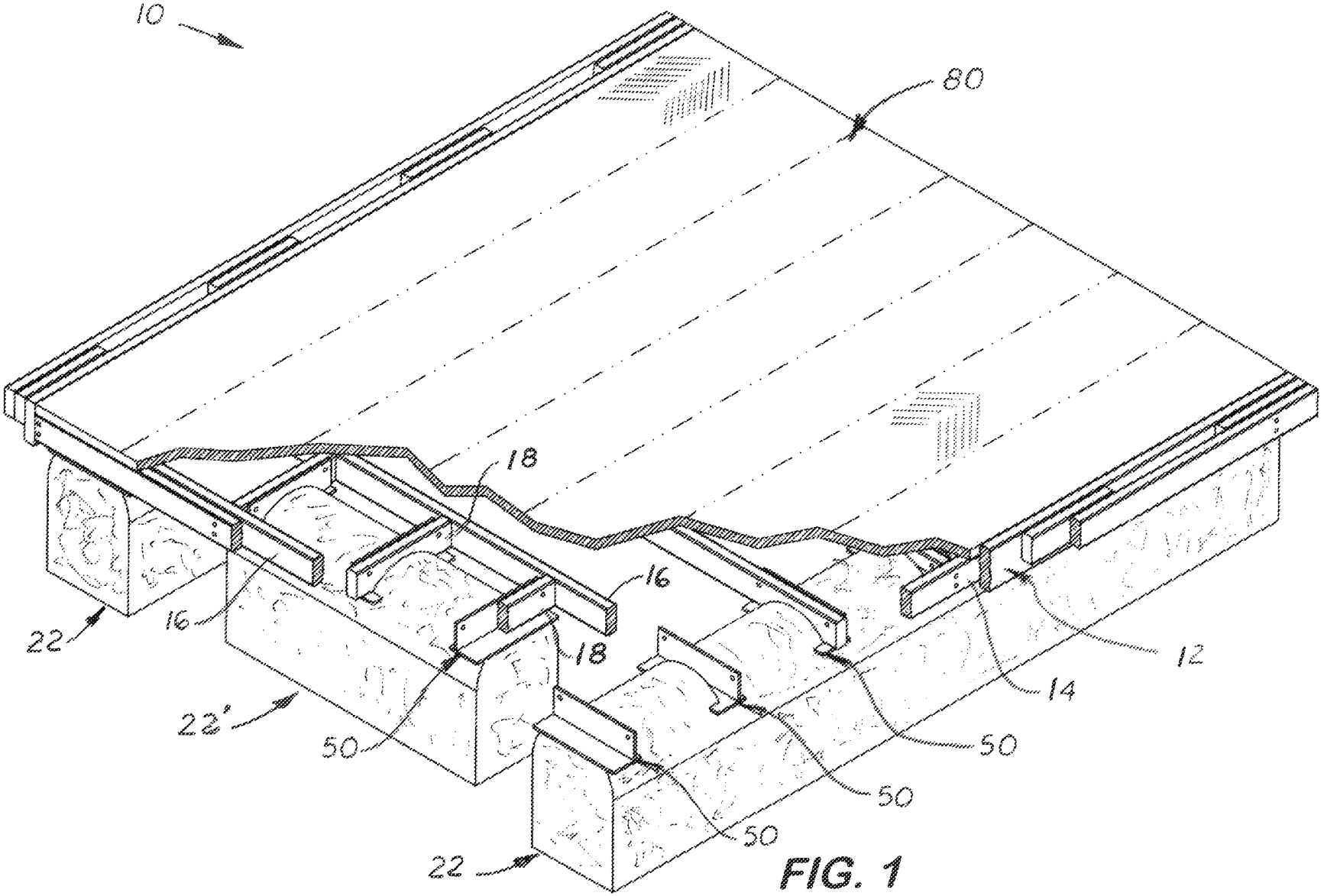
FIG. 1 is a perspective view of a floating structure, such as a swim raft, with the decking partially broken away that use two elongated float bodies and two short float bodies.

FIG. 1 is a perspective view of a floating structure 10, such as a swim raft, with its decking 80 partially broken away. The decking 80 is attached to a lower frame 12 that includes a plurality of joists 14, beams 16 and cross members 18. On opposite sides of the floating structure 10 are wo parallel, elongated float bodies 22. On the opposite ends of the floating structure 10 and under the lower frame 12 are two, optional short float bodies 22'

As shown in FIGS. 2-6, the elongated float bodies 22 are made of closed cell foam covered by a protective layer 45. In the embodiment shown herein, the foam is made of PVC and the protective layer 45 is made of polyurea applied by spray application. It should be understood that other types of foams and protective layers may be used.

Figure 2:
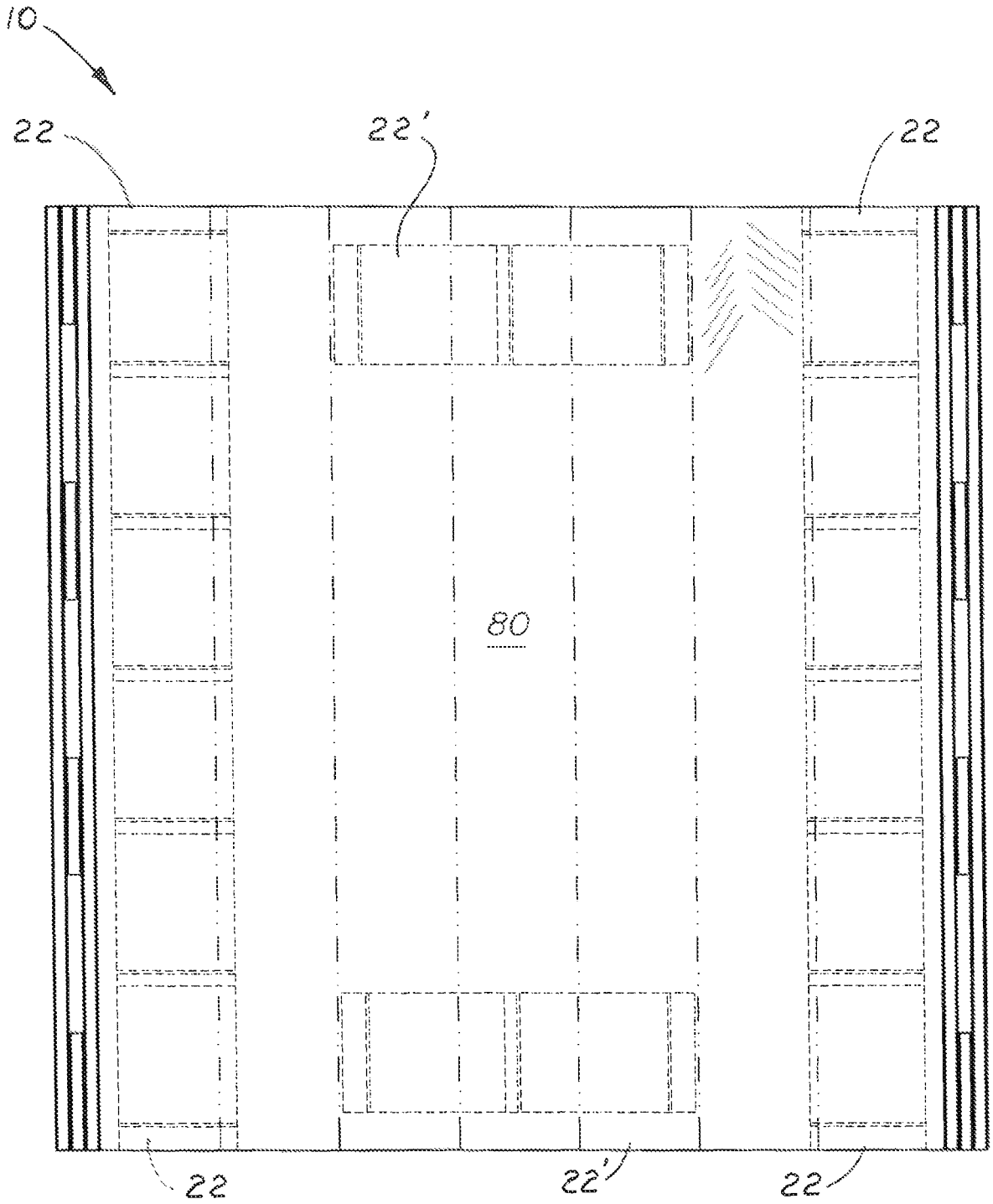
FIG. 2 is a top plan view of the floating structure shown in FIG. 1.
Figure 3:
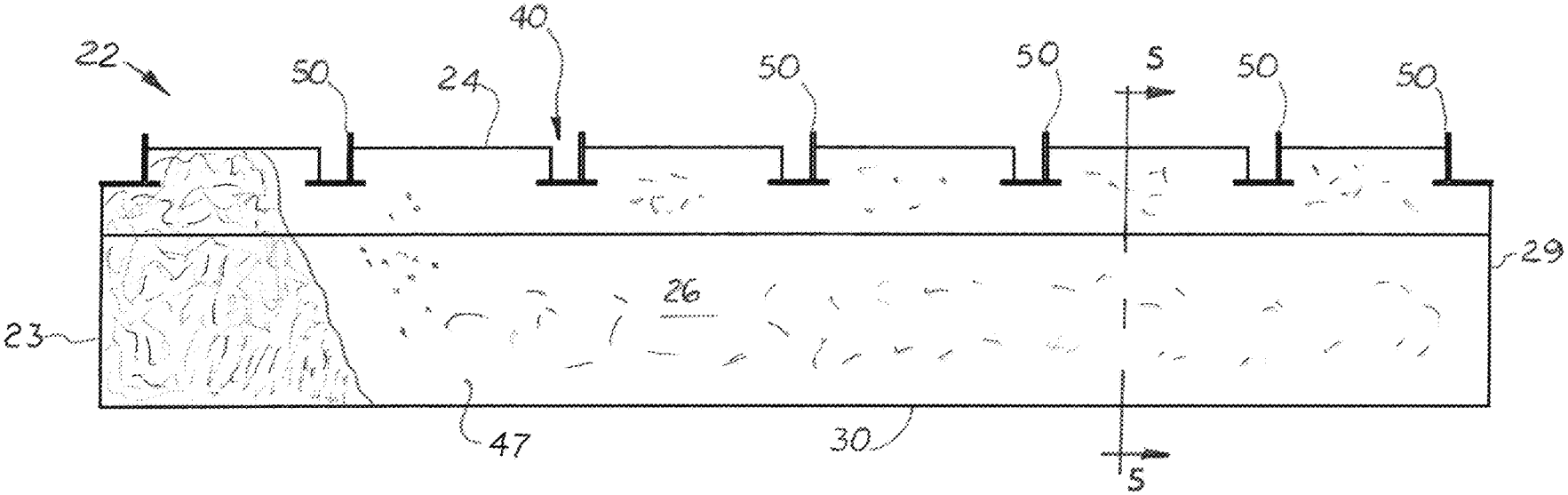
FIG. 3 is a side elevational view of a floating structure.
Figure 4:
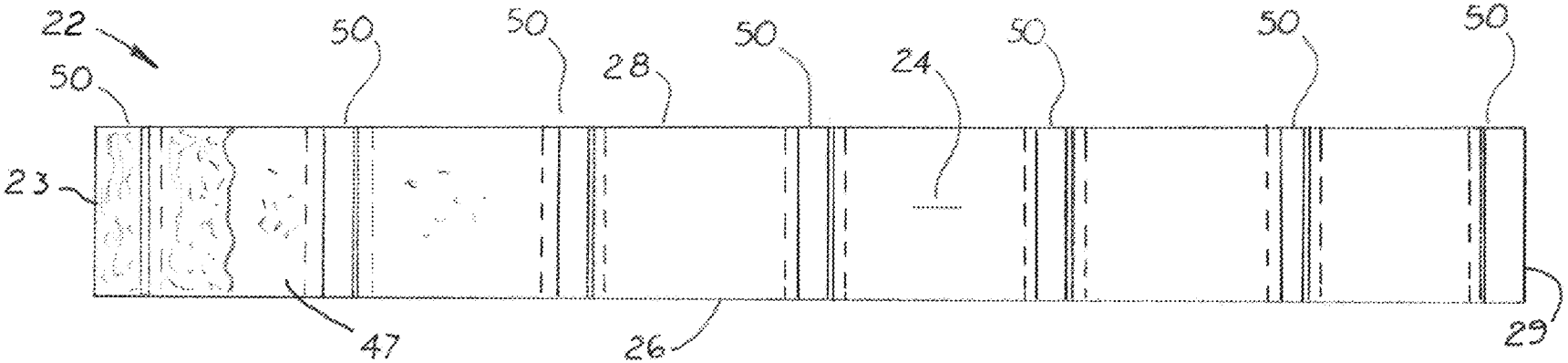
FIG. 4 is a top plan view of the floating structure shown in FIG. 3.
Figure 5:
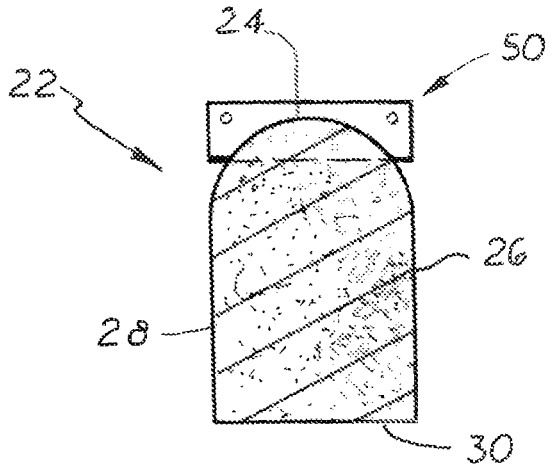
FIG. 5 is a sectional view of the float body taken along line 5-5 in FIG. 3.
Figure 6:
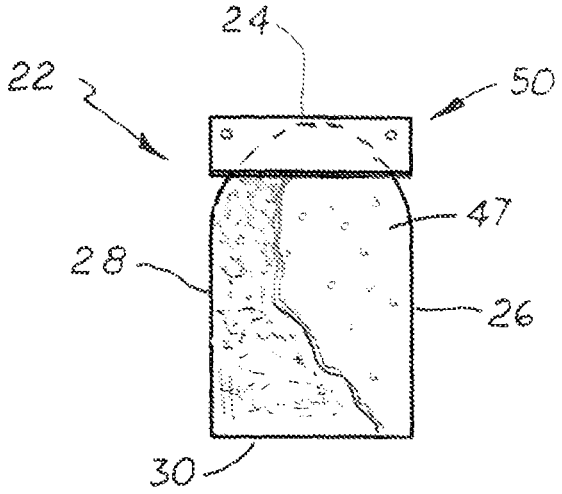
FIG. 6 is a front elevational view of the floating structure shown in FIG. 3.

Each float body 22 includes a round top surface 24, two straight vertical sides 26, 28 and a flat bottom surface 30 In the embodiment shown, the float body 22 measures approximately 12 inches in width, approximately 18 inches in height. The elongated float body 22 is approximately 96 inches in length. The short elongated float body 2'2 shown in FIGS. 1 and 2 is approximately 48 inches in length It should be understood both the elongated float body 22 and short float body 22' made be made in different lengths, widths, and heights.

The top surface 24 is round, dome-shaped. In the embodiment shown in the FIGS., the top surface is a continuous arc extending from opposite sides 26, 28. The top surface 24 has a radius of approximately 18 inches. As stated above, the purpose of using a round top surface 24 is to prevent stagnant water or debris build up on the float body 22. It should be understood the top surface 24 may be other shapes, such as a beveled or conical surface that prevents debris build up.

As stated above, each float body 22, 22' is made of closed-cell foam molded into an elongated float shape. While the sides 26, 28 and the bottom surface 30 are shown as flat surfaces and perpendicularly aligned with the adjacent surface. It should be understood these surfaces could be round or irregular shaped and aligned non-perpendicular to the adjacent surface.

A plurality of T-shaped or L-shaped brackets 50 is embedded into the top surface 24, 24' of each float body 22, 22', respectively. In one embodiment, the transversely aligned bracket cutouts 40 are formed in the top surface 24, 24' of the float bodies 22, 22. The shape of bracket cutouts 40 is inverted 't' shaped and complementary to the brackets 50.

In one embodiment, the bracket cutouts 40 are formed after the float body 22, 22' are formed with, a hot wire cutter (not shown). It should also be understood that brackets 50 may be placed in the mold form and foam material is then poured into the mold form. Foam material cures around the brackets 50 to form a single float body 22 with a plurality of upward extending brackets 50 embedded into the float body 22.

After the float body 22 has been manufactured and the brackets 50 have been inserted into the bracket cutouts 40, caulking 45 is applied to the cracks between the float body 22 and the brackets 50. Polyurea coating 47 is then sprayed over the entire float body 22. When the polyurea coating 47 has hardened, it protects the float body 22 and seals and locks the brackets 50 inside the bracket cutouts 40.

Figure 7:
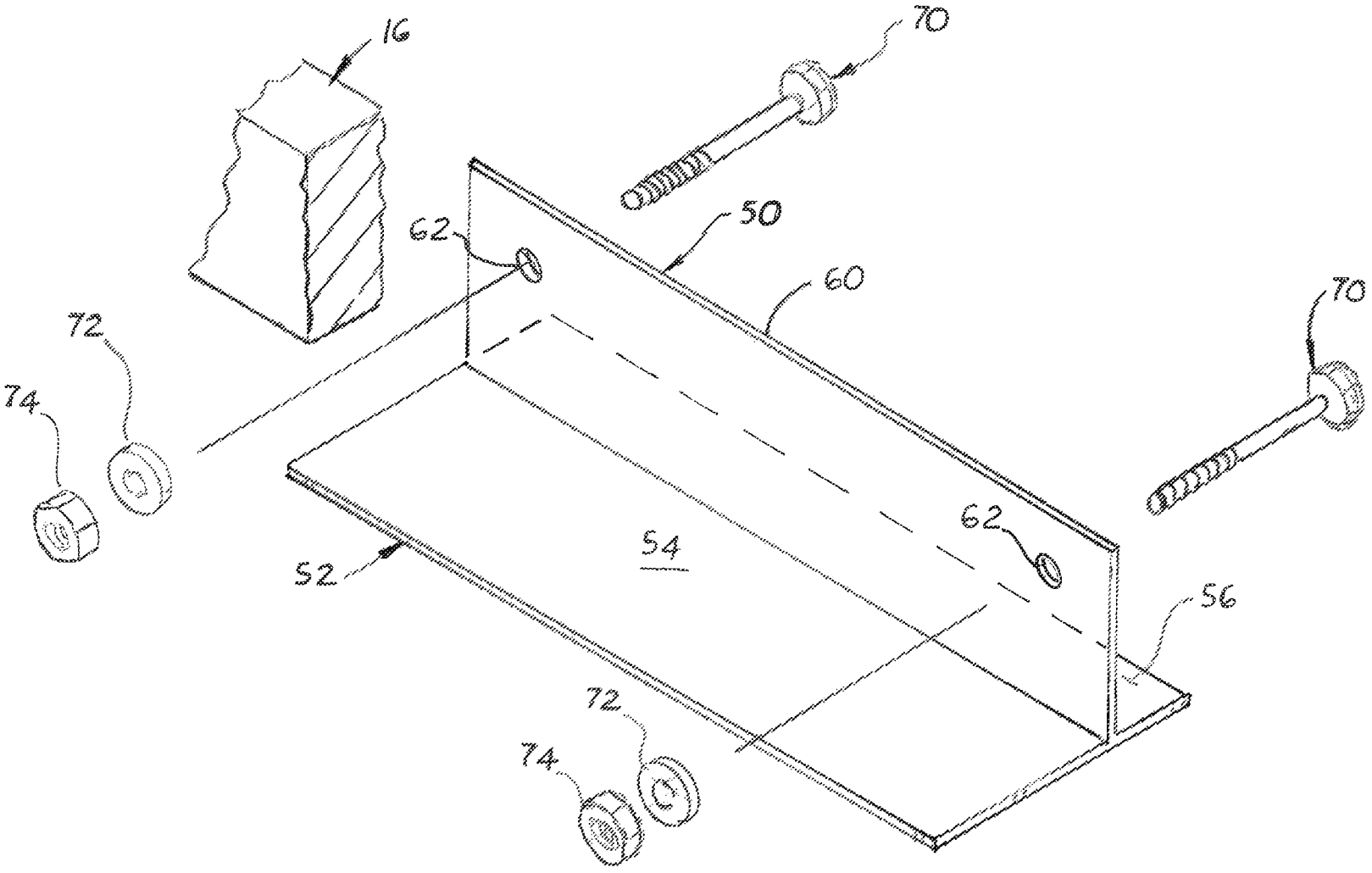
FIG. 7 is a perspective view of a bracket.
Figure 8:
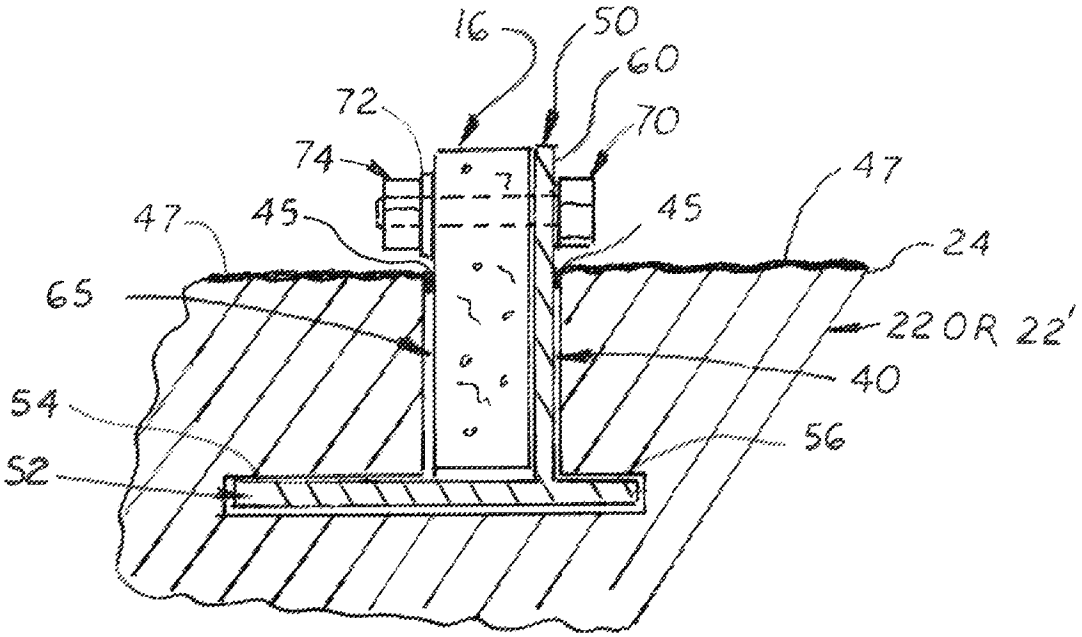
FIG. 8 is a sectional side elevational view of a floating structure with a bracket channel and showing a frame member with the frame member attached to the vertical flange.

As shown in FIG. 7, each bracket 50 includes a horizontal flange 52 and a perpendicularly aligned vertical flange 60. The horizontal flange 52 is a flat plate configured to extend horizontally and transversely through the upper portion of the float body 22. The vertical flange 60 is a flat plate that extends upward from the horizontal flange 52. The vertical flange 60 is approximately the same length as the horizontal flange 22 and is sufficient in width so that the upper edge of the vertical flange 60 extends above the top surface 24 of the float body 22. In the embodiment shown in the FIGS., the vertical flange 60 is slightly offset from the horizontal flange's longitudinal axis 61, thereby dividing the horizontal flange 52 into a first section 54 and a second section 56. Formed on the upper portion of the vertical flange 60 are holes 62 that receive threaded connectors 70, such as a bolt. A washer 72 and nut 74 are attached to the opposite end of the threaded connector 70.

In one embodiment, a frame member void space 65 is formed on the top surface 24 of the float body 22 adjacent to the vertical flange 60. In the first embodiment, the void space 65 is formed after the float body 22 has been formed using a hot wire. It should be understood, however, that the mold space 65 could be formed in the molding process.

The void space 65 extends downward from the top surface 24 and exposes part of the first section 54 on the horizontal flange 52. The void space 65 extends transversely over the float body 22 and is sufficient in width to receive a frame member extending transversely over the float body 22. During use, threaded connectors 70 transfer forces through the vertical flange 60 onto the frame member 16 and the horizontal flange 52 transfers forces to the bottom of the frame member 16. Because the void space 65 is approximately the same width as the frame member 16, the frame member 16 becomes 'locked' into the float body 22.

Figure 9:
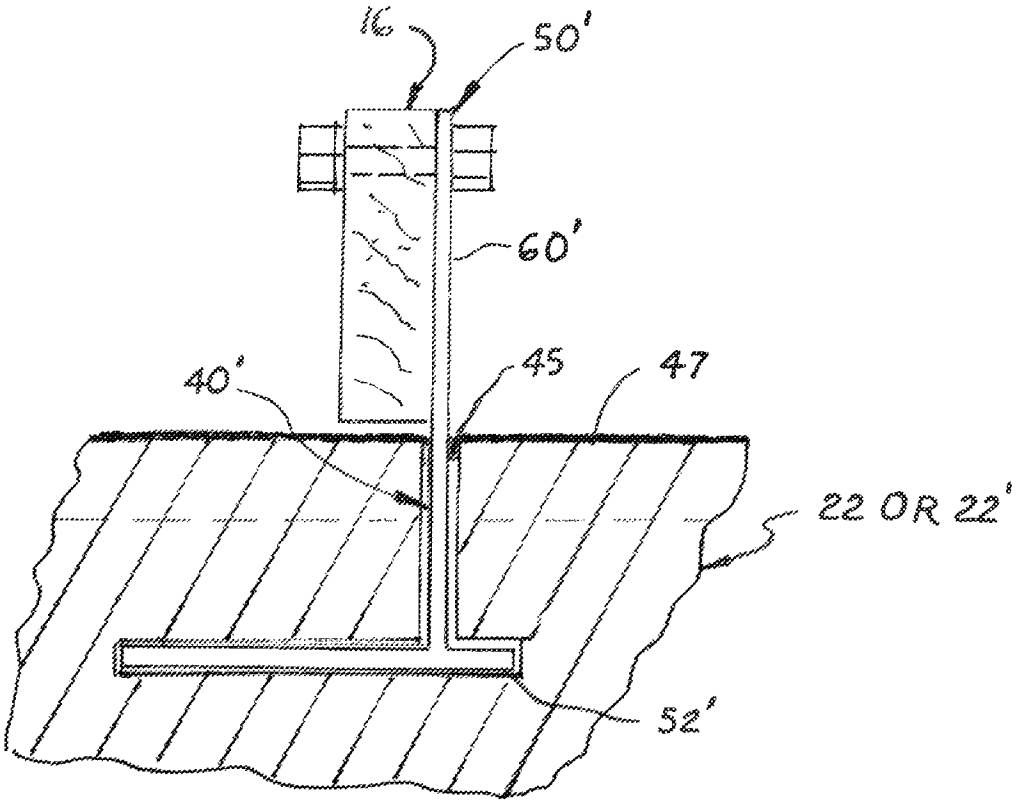
FIG. 9 is a sectional side elevational view of a float with a bracket channel with a narrow vertical slot and a modified bracket inserted into the bracket channel and showing a frame member attached to the exposed area on the vertical frame.

In another embodiment, shown in FIG. 9, bracket 50 includes a modified vertical flange 60' extending above the top 24 of the float body 22. The vertical flange 60' fits inside a bracket cutout 40' slot formed on the float body 22. In this embodiment, the entire horizontal flange 52' is embedded and covered by the float body 22. A frame member 16 then extends over the top surface 24 of the float body 22 and attaches to the exposed area on the vertical flange 54' above the top surface 24 with threaded connectors 70.

Using the above described float and bracket assembly, a floating structure shown in FIG. 1 may be constructed. As stated above, the floating structure 10 includes a lower frame 12 that includes a plurality of joists 14, beams 16 and cross members 18. Attached to the top surface of the frame 12 is decking 80. Located under the frame 12 are two elongated float bodies 22 and two short float bodies 22'. Mounted on each float body 22, 22' are brackets 50 attached to the frame 12.

In compliance with the statute, the invention described has been described in language more or less specific as to structural, features. It should be understood however, that the invention is not limited to the specific features shown, since the means and construction shown, comprises the preferred embodiments for putting the invention into effect. The invention is therefore claimed in its forms or modifications within the legitimate and valid scope of the amended claims, appropriately interpreted under the doctrine of equivalents.

We claim:

1. A combination float and bracket assembly, comprising:

a. a float body made of closed-cell foam, said float body includes two side surfaces, a bottom surface, and a top surface configured to prevent water and debris collecting thereon;

b. a plurality of brackets transversely aligned over said top surface of said float body, each said bracket includes a horizontal flange and a vertical flange, said horizontal flange being at least partially embedded into said float body and said vertical flange extending upward from said top surface, said vertical flange includes at least two holes located above said top surface of said float body; and c. protective outer layer over said float body.

2. The assembly, as recited in claim 1, further including a frame member void area formed in said top surface located adjacent to said vertical flange on said bracket, said void area configured to receive a frame member used on a floating raft or dock that extends transversely over said top surface of said float body.

3. The assembly, as recited in claim 1, wherein said protective outer layer is a polyurea coating.

4. The assembly, as recited in claim 2, wherein said protective outer layer is a polyurea coating.

5. The assembly, as recited in claim 1, wherein said top surface of said float body is curved upward.

6. The assembly, as recited in claim 2, wherein said top surface of said float body is curved upward.

7. The assembly, as recited in claim 4, wherein said top surface of said float body is curved upward.

8. A floating structure, comprising:

a. a frame made of a plurality of frame members connected together, said frame includes a top surface;

b. decking material attached to said top surface of said frame;

c. a plurality of float bodies each made of closed-cell foam, each said float body includes two side surfaces, a bottom surface and a top surface configured to prevent water and debris from collecting thereon, each said float body covered with a protective outer layer;

d. a plurality of brackets transversely aligned over said top surface of each said float body, each said bracket includes a horizontal flange and a vertical flange, said horizontal flange being at least partially embedded into said float body and said vertical flange extending upward from said top surface, said vertical flange includes at least two holes located above said top surface of said float body; and e. a plurality of connectors attaching said holes on said vertical flange to said frame members on said frame.

9. The floating structure as recited in claim 8, wherein said protective outer layer is a polyurea coating.

10. The assembly, as recited in claim 8, further includes a frame member void area formed in said top surface adjacent to said vertical flange on each said bracket, said void area configured to receive a frame member that extends transversely over said top surface of said float body.

11. The assembly, as recited in claim 9, further including a frame member void area formed in said top surface located adjacent to said vertical flange on each said bracket, said void area configured to receive a frame member that extends transversely over said top surface of said float body.

* * * * *